United States Patent [19]

Stroud et al.

[11] Patent Number: 4,788,913

[45] Date of Patent: Dec. 6, 1988

[54] FLYING-PLATE DETONATOR USING A HIGH-DENSITY HIGH EXPLOSIVE

[75] Inventors: John R. Stroud; Donald L. Ornellas, both of Livermore, Calif.

[73] Assignee: The United States of America as represented by the United States Department of Energy, Washington, D.C.

[21] Appl. No.: 150,950

[22] Filed: Jun. 2, 1971

[51] Int. Cl.[4] ..... F42C 19/12

[52] U.S. Cl. ..... 102/202.5; 102/204

[58] Field of Search ..... 102/28 EB, 202.5, 204

[56] References Cited

U.S. PATENT DOCUMENTS

| | | | |
|---|---|---|---|
| 3,062,143 | 11/1962 | Savitt et al. | 102/28 |
| 3,100,447 | 8/1963 | Betts | 102/28 EB |
| 3,181,463 | 5/1965 | Morgan et al. | 102/28 EB |

*Primary Examiner*—Charles T. Jordan

*Attorney, Agent, or Firm*—L. E. Carnahan; Roger S. Gaither; Judson R. Hightower

[57] ABSTRACT

A flying-plate detonator containing a high-density high explosive such as benzotrifuroxan (BTF). The detonator involves the electrical explosion of a thin metal foil which punches out a flyer from a layer overlying the foil, and the flyer striking a high-density explosive pellet of BTF, which is more thermally stable than the conventional detonator using pentaerythritol tetranitrate (PETN).

9 Claims, 2 Drawing Sheets

FLYING-PLATE DETONATOR USING A HIGH-DENSITY HIGH EXPLOSIVE

The invention described herein was made in the course of, or under, Contract No. W-7405-E with the U.S. Atomic Energy Commission.

BACKGROUND OF THE INVENTION

This invention relates to detonators for high-density chemical explosives, such as that utilized in initiating nuclear explosives, and more particulary to such a detonator of the flying-plate type utilizing benzotrifuroxan (BTF), also known as hexanitrosobenzene (HNB).

High density chemical explosives are relatively difficult to detonate and various types of detonators have been developed in the prior art to solve this problem. Virtually all of the prior known electrically operated detonators utilize either hot wire initiation of high density primary explosives, or exploding bridgewire (EBW) initiation of low-density secondary explosives which subsequently ignites the high density main charge. Of these two types the exploding bridgewire is the more widely used in nuclear explosives.

In an exploding bridgewire detonator, a thin wire is explosively vaporized by a large current pulse which ignites the low-density chemical explosive. Of the prior art detonators the exploding bridgewire detonator is the most safe, reliable, and consistent. However, because the detonator requires a low density intermediary explosive, they are to as vulnerable such factors heating aging vibration, and contamination, as well as the fabrication process which requires extreme precision.

The use of exploding foils for the production of shock waves and for the acceleration of thin plates or "slappers" is known in the prior art as evidenced by pages 245–298 of "Exploding Wires", vol. 2, 1962, edited by W. G. Chace and H. K. Moore, published by Plenum Press. Also, the composition BTF as a main explosive charge is old, per se, as evidenced by an article published in "Acta Cryst", Mar. 1966, page 336. However, prior to the present invention the utilization of this composition was never considered for initiation purposes.

SUMMARY OF THE INVENTION

The present invention overcomes the disadvantages of the prior art electrically operated detonators by providing a flying-plate detonator which utilizes high-density benzotrifuroxan (BTF). Flying-plate type detonators have greater advantages and improved over the above-mentioned hot wire initiation type and the exploding bridgewire (EBW) type, primarily in that it can be utilized for detonating the main charge explosives directly by use of appropriate metal flyer-plates, or for initiation of intermediate or secondary explosive pellet, which for example, may have as high a density as the main explosive, by use of single-layer flyer-plates of dielectric materials. In addition, with BTF being utilized as the explosive pellet, there is relatively good thermal stability, compared with pentaerythritol tetranitrate (PETN), which minimizes timing changes in detonators stored at elevated temperature or for long periods of time at ambient temperature. Elimination of low-density explosives by the instant invention solves most of the environmental and production problems of EBW detonators In addition the inventive detonator is safer than hot wire detonators because they contain no primary explosive, and safer than EBW detonators because they contain no low-density explosive and require more energy to fire.

Therefore, it is an object of the present invention to provide an improved electrically operated explosive detonator, particularly adapted for activating nuclear explosives.

A further object of the invention is to provide a flying-plate detonator capable of actuating a high-density explosive directly, or through a high-density explosive pellet.

Another object of the invention is to provide a flying-plate type detonator which utilizes BTF as the explosive pellet therein.

Another object of the invention is to provide a detonator which solves most of the environmental and production problems of the prior known detonators, and which is safer than these prior detonators.

Other objects of the invention will become readily apparent from the following description and accompanying drawings.

DESCRIPTION OF THE INVENTION

The principle of the invention flying-plate detonator involves the electrical explosion of a thin metal foil, the resultant punching out of a flyer from a layer overlying the foil, and the flyer's striking a high-density explosive pellet of benzotrifuroxan (BTF), also known as hexanitrosobenzene (HNB).

The flying-plate detonator differs from the conventional exploding bridgewire (EBW) detonator in two main respects: (1) the exploding metal does not contact the high explosive (HE) directly, and (2) the HE pellet can be pressed to high density. The inventive detonator has advantages over the EBW detonator in its low cost, ease of manufacture, better environmental stability, and reduced vulnerability to countermeasures. Although it requires more electrical power than an EBW, the requirement is well within the capability of modern weapon firesets.

While the inventive flying-plate detonator may be utilized to directly detonate the main or primary explosive using metal flyers, the embodiment described hereinafter in detail initiate intermediate high-density booster pellets using single-layer flyers of dielectric materials or a laminate of dielectric and metal. The high-density pellets are composed of benzotrifuroxan (BTF), also known as hexanitrosobenzene (HNB) which is more heat-stable than pentaerythritoltetranitrate (PETN) conventionally utilized in detonators.

As pointed out above, the inventive flying-plate detonators eliminates the use of low-density explosives which solves most of the environmental and production problems of EBW detonators. The flying-plate detonators are safer than hot wire detonators because they contain no primary explosive, and safer than EBW detonators because they contain no low-density explosive and require more energy to fire.

Although the main charge can be initiated directly, there are advantages to be gained through the use of an intermediate high-density output or booster pellet. The pellet material can be tailored to be more shock-sensitive than main charge explosives, resulting in less power required for each detonator. Moreover, it can be formulated so as to have better dimensional stability on exposure to extreme environments than the currently used explosives, which will serve to maintain proper standoff and thus aid in the preservation of good simultaneity between detonators.

While the flying-plate detonator does require more power per detonator than EBW detonators, current firesets can easily supply the power required. Thus both single and multi-point systems can be ignited with the inventive detonators.

Figure 1:
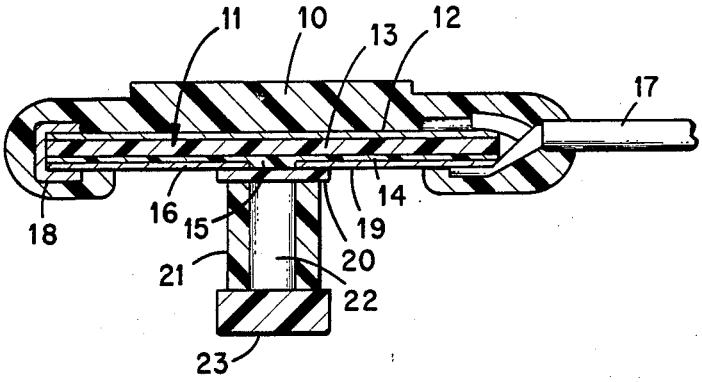
FIG. 1 is a cross-sectional view of an embodiment of the inventive flying-plate detonator.

Referring now to the FIG. 1 embodiment, the thus illustrated flying-plate detonator consists of a backing or head 10 which secures therein a printed circuit board generally indicated at 11 having an overall thickness of 31 mils, for example and composed of an upper electrode 12, a suitable dielectric substrate 13, an insulation layer 14, such as Epon 828, and having a protruding portion 15, and a lower electrode 16 configured to allow protruding portion 15 of insulation layer 14 to extend therethrough and be flush therewith, electrodes 12 and 16 being made, for example, of 5 mil thick copper. The head 10 is configured so as to provide a backing surface for the printed circuit board 11 of from about 125 to 250 mils thick, for example. A firing lead cable 17 extends into head 10 and is electrically secured to one end of each of electrodes 12 and 16. A jumper 18 is secured across the other ends of electrodes 12 and 16, jumper 18 being constructed of 5 mil thick copper, for example. An exploding foil 19, of gold, for example, with a thickness of 0.1 to 0.5 mils is electrically secured to electrode 16. A sheet 20 of Mylar, or other suitable flyer material, of a thickness in the range of 2–75 mils, is secured between the exploding foil 19 and a spacer or standoff 21, which for example may be constructed of fucite or polymethyl methacrylate. Spacer or standoff 21 is provided with an air space or bore 22, which in this example is square in cross-section with a width of 60–100 mils and a length of from 5–250 mils. A high-density explosive pellet 23 of benzotrifuroxan (BTF) is secured to the standoff 21, pellet 23, for example, being 250 mils in diameter and 100 mils in length.

In operation of the FIG. 1 embodiment, a large current pulse, from a source not shown, is directed through firing cable 17 and across electrodes 12 and 16 explosively vaporizing the foil or film 19 which causes a flyer or disc to be cut out of sheet 20 and driven down the bore 22 or spacer or standoff 21 striking the high-density explosive pellet 23 which explodes and detonates an associated main or primary charge, not shown. The length and diameter of the bore 22, and the thickness of the flyer, as described in greater detail hereinafter, is set such that the flyer from sheet 20 reaches a maximum velocity just before impacting against the pellet 23. More specifically, the area of the planar pressure shock is determined by the cross sectional area of the flyer. It is slightly greater than the minimum critical area required for positive detonation of the explosive pellet. The magnitude and duration of the pressure shock are dependent on the thickness of the flyer film or layer and the magnitude of the acceleration generated by the explosively-vaporized conductive foil. In tests conducted with the FIG. 1 embodiment, the fireset used was a 5.8 $\mu$F capacitor discharge unit (CDU), with a maximum design voltage capability of 6,000 volts, with the inductance and resistance being approximately 218 nH and 124 m$\Omega$, respectively. It was determined that burst current, with a given firing unit is in proportion to foil or flyer thickness.

Figure 2:
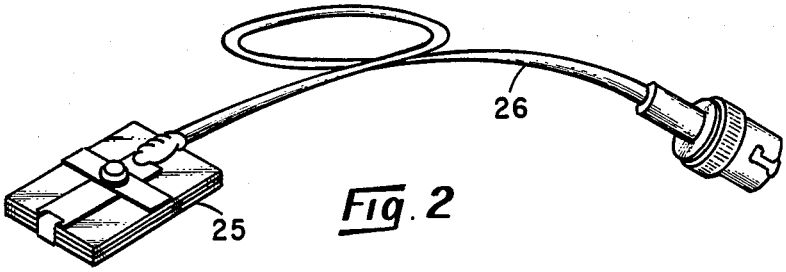
FIG. 2 is a perspective view of a flat-cable embodiment of the inventive detonator.
Figure 3:
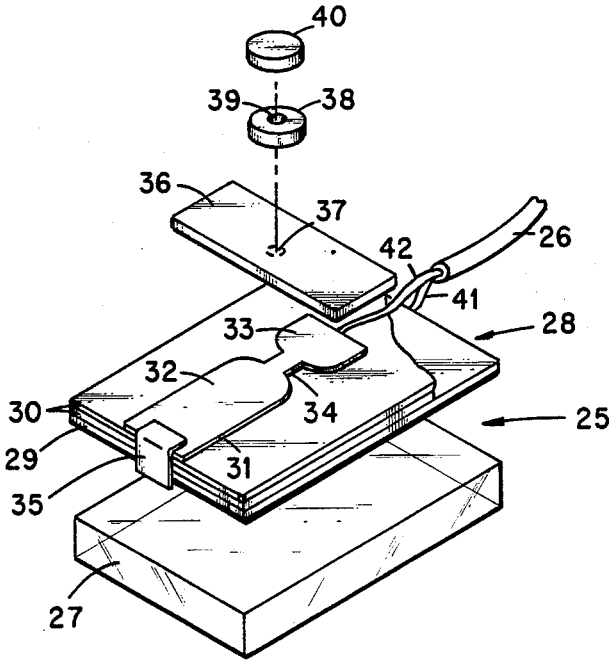
FIG. 3 is an enlarged, partially exploded view of the FIG. 2 embodiment.

The flat-cable embodiment illustrated in FIGS. 2 and 3 basically comprises a flat-cable assembly 25, and a firing cable 26, assembly 25, for example having an overall length of two inches. It is termed a flat-cable assembly because it is fabricated, for example, from a large sheet of aluminum-Mylar-aluminum laminate using conventional flat-cable technology. As seen more clearly in FIG. 3, the assembly 25 comprises a backing member 27 of Lucite, for example, having a thickness of 62 mils; a sheet of aluminum -Mylar-Aluminum laminate generally indicated at 28 including an aluminum backing or lower layer 29 of a 4 mil thickness, two layers 30 of Mylar of 5 mils each, and an upper aluminum layer or foil of a 0.45 mil thickness generally indicated at 31 and etched away to form a pair of lands 32 and 33 and an interconnecting bridgefoil 34 which is 80 mils wide layers 29 and 31 constituting electrodes interconnected by a copper jumper 35; a Mylar or polyimide film or layer 36 of 3 mils thick centrally positioned over bridgefoil 34 from which a flyer or disc 37 is formed; a standoff or spacer 38 of nonconductive material is positioned over film 36 with a bore 39 thereof positioned over flyer 37, standoff 38 being 30 mils thick with bore 39 having a 125 mil diameter; an H.E. pellet 40 of BTF positioned over standoff 38, pellet 40 being 100 mils thick and 250 mils in diameter; and electric leads 41 and 42 of cable 26 connected to respective electrodes 29 and 31. The above materials and measurements are set forth as exemplory only, with no intention to limit this embodiment to the specifics described. In tests conducted on the FIGS. 2 and 3 embodiment, the fireset was a 5.8 $\mu$F. (CDU) with a maximum design voltage capacity of 6,000 volts, with an inductance of 102 nH and a resistance of 46 m$\Omega$.

During test conducted on the inventive detonator, various design variables considered are: (1) the composition, thickness, width, and length of the bridgefoil 34; (2) the composition and thickness of the flyer 37; (3) the flight distance or length of standoff bore 39; and (4) the confinement of the exploding foil 31. As a result, it has been determined that threshold burst current can be decreased by reducing the dimensions of the bridgefoil. There is a minimum area required for the detonation of each explosive, and this area in turn will determine the minimum threshold current. The bridgefoils tested were of a square configuration and ranged in sizes from 80 mils per side to 7 mils per side; the thickness being varied from 0.5 mil to 0.05 mil, with the bridgefoil materials being gold, aluminum and copper.

The flyers 37 (formed from film 36) tested included both single films of dielectric materials and composites of dielectric and metal. The best energy transfer was obtained when the impedance of the flyer matches that of the explosive, so the choice of explosive influences the the optimum flyer materials. Most of the commercially available plastic films have been assessed along with glass and mica. Aluminum, copper, brass, and steel have been used as the metals in composite flyers. The best results, using the relatively sensitive explosives, have been obtained with the plastic films as flyers; for example, Mylar or polyimide has been shown to be very satisfactory. Flyer thickness has varied from 0.5 mil up to 7 mils. While the thickness had little influence on threshold current, it has a strong influence on transit time because thin films accelerate more rapidly. The useable range of flyer thickness is dependent on the foil thickness, and a large change in foil thickness should be accompanied by a comparable change in flyer thickness.

The distance or thickness of standoff 38 between the flyer 37 and the explosive pellet 40 has been varied from 0 to 250 mils. Good performance required a standoff thickness less than 40 mils. Velocity history plots show that the flyer 37 accelerates in the interval from 5 to 20 mils, depending on design parameters, and then decelerates. Best performance is obtained if the spacing or length of bore 39 is chosen for maximum velocity. Performance suffers at long distances due to the reduced speed and the instability of the flyer. The optimum standoff varies with firing voltage, and is thus influenced by the choice of fireset. The velocities obtained in these tests varied from less than 1 mm/μsec to over 5. The high velocities were observed only with the very thin flyers. Most of the measurements were in the range from 2 to 3 mm/μsec.

The confinement of the exploding foil 31 is very important. The exploding foil can be confined either beneath the flyer film 36 or continuous over an area large compared to the foil size or in a bore ("gun barrel") arrangement. The effect of the size of bore 39 has been tested over a range from 15 mil diameter up to an area very much larger than the area of bridgefoil 34, such as 250 mils. If the flyer film 36 covers only the bridgefoil area, then a bore size smaller than the bridgefoil must be used for good performance. If the film is continuous, then a bore larger than the bridgefoil gives the optimum performance.

The initiation behavior of several basic explosives and several combinations of explosives and binder materials has been assessed. Although the main or primary explosive can be initiated directly, as pointed out above , there are two major advantages in using an intermediate pellet: (1) the composition of the pellet explosive 40 can be tailored to make the pellet more shock sensitive than the main explosive, thus reducing the electrical power required for detonation, and (2) the mechanical properties of the pellet explosive can be altered to make the pellet more creep resistant than the main explosive, allowing the standoff gap or distance to be maintained during storage, and thus permitting good simultaneity between detonators.

The following basic explosives have been evaluated: pentaerythritol tetranitrate (PETN), cyclotrimethylenetrinitramine (RDX), cyclotetramethylenetetranitramine (HMX), diaminotrinitrobenzene (DATB), hexanitrostilbene (HNS), and benzotrifuroxan (BTF), also known as hexanitrosobenzene (HNB) The binders included plastics (Exon, Viton, dinitropropylacrylate (DNPA), and silicon rubber) and metals (indium and silver). The tests showed that HNB bonded with Exon produced better results in that it is as thermally stable as any of the main explosives, has a threshold (sensitivity to shock) approximately the same as pure PETN commonly utilized, has good mechanical properties, and can be readily molded into pellets on automatic equipment. This explosive material will be described in greater detail hereinbelow.

The effect of specific surface between 3,500 and 16,000 $cm^2/g$ is negligible. This is in contrast to the conventional EBW detonators, in which specific surface has large effect on transit time and threshold. Varying the pellet density from approximately 80 percent of theoretical density to approximately 98 percent has a negligible effect on transit time but does influence threshold (the higher density reduces the sensitivity). The effect of adding binders is an increase in both transit time and threshold current. The increase, however, is acceptably small.

As also pointed out above, the inventive flying-plate detonators require considerably more power than the EBW detonators. Typical values for burst-current threshold in EBW detonators range from 200 to 300 amps which the lowest threshold achieved in thus far conducted tests on the flying-plate detonators is 1700 amps. However, the large foils inherently burst at higher currents than the small wires used in EBW detonators if both are fired with the same capacitor-discharge unit. The selection of design parameters is strongly influenced by the type of fireset planned for a given application. Good performance can be obtained over a wide range of design parameters, thus making the optimization to a given firing unit straightforward.

The inventive flying-plate detonator is much less sensitive to small dimensional changes than EBW detonators. Whereas a gap between the bridgewire and the powder can cause an EBW detonator to fail, the same spacing would cause only a minor difference in transit time in the flying-plate detonator. With the elimination of low-density powder, which is required in an EBW detonator, the inventive detonator is easier to produce and more resistant to environmental stress.

BTF is more heat-stable than PETN, conventionally used in EBW detonators, and sensitive to bridgewire initiation. Its firing performance has been tested both in a low-density pressing initiated by an exploding bridgewire, and in the high density pellet initiated by the flying-plate.

The synthesis of hexanitrosobenzene was first reported in 1931 by O. Turek published in Acta Cryst, 20, pt. 3, 336 (1966). It results from the heating of trinitrotriazidobenzene (TNTAB) as the final step in the process.

The general characteristics of BTF are listed in the top portion of Table 1; the lower section contains data found for a particular batch used in testing.

TABLE I

| GENERAL |
|---|
| Also known as hexanitrosobenzene |
| TMD = 1.901 $g/cm^3$ |
| M.W. = 252.11 |
| Nonhygroscopic |
| Chemical formula, $C_6N_6O_6$ |
| Not a primary explosive |
| Comparable to tetryl in its explosive properties |
| Detonation velocity = 8274 m/sec at 1.766 $g/cm^3$. |

| TEST BATCH | |
|---|---|
| Supplier: Aldrich Chemical Company, New Jersey | |
| Melting point = 196–198° C. | |
| Color: | Off white (changes to orange-brown in laboratory light unless stored in dark bottles). |
| Purity: | >95% |
| Thermal stability (one run): | 0.46 $cm^3/g$ of gas evolved when held at 120° C. for 22 hr. PETN evolves |

TABLE I-continued

| | |
|---|---|
| | 0.48 to 0.84 $cm^3/g$ depending on the batch; HMX evolves $<0.04$ $cm^3g$. |
| Differential thermal analysis: | no appreciable decomposition until after melt temperature was reached. |

For low-density applications, the HNB was tested in a conventional exploding-bridgewire configuration wherein it was pressed to a density of 0.91 $g/cm^3$ against a 1.5×20-mil gold bridgewire with an ionization switch positioned against the BTF thus forming a low-density powder. The fireset used was a 1.99 μF capacitive-discharge unit (CDU) of 639 nH inductance and 250 mΩ resistance.

Figure 4:
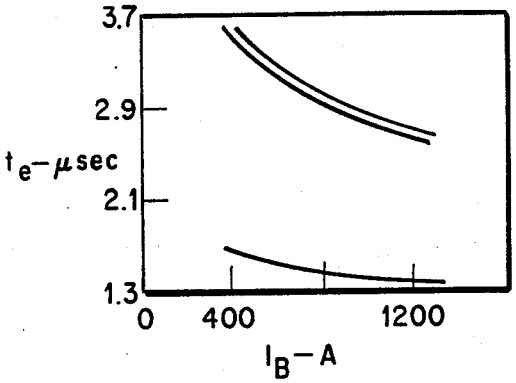
FIGS. 4 and 5 are graphs showing initiation of low-density explosive pressings of BTF (HNB) and PETN.
Figure 5:
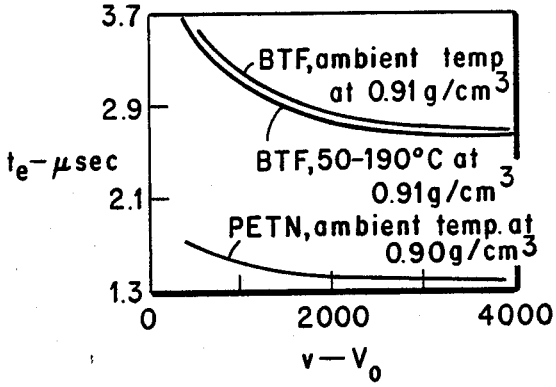

The plot of $t_e$ vs $I_B$ (time from bridgewire burst to ionization switch closure vs burst current) and $t_e$ vs $V_O$ ($V_O$ is firing voltage on the CDU, not burst voltage of wire) for BTF are shown in FIGS. 4 and 5, respectively, in comparison with the curves obtained for PETN in the same type of testing system. In each of the two plots, the uppermost curve is for BTF (HNB) fired at ambient conditions with no prior heat exposure, at a density of 0.91 $g/cm^3$. The next curve down is for BTF fired at ambient after a heat exposure of 30 hr. at 190° F. (88° C.). The bottom curve is that obtained for 3500 $cm^2/g$ PETN at a density of 0.90$g/cm^3$, which was fired at ambient with no heat exposure.

In these low-density tests, the transmission time for BTF is over a microsecond longer than for PETN. However, the threshold is the same, and BTF exhibits the characteristic of shorter times after heat exposure than with no prior heating. More important is the fact that the two curves (no heat and heat) of the BTF are only about five shakes apart. These tightly grouped data indicates that good simultaneity can be obtained in salvo firing.

For high-density pellet testing utilizing the flying-plate detonator, the pellets of BTF (HNB)were 0.250 inches in diameter and 0.100 inch thick, and were pressed to 90% of theoretical maximum density (TMD) which put them at 1.71 $g/cm^3$ (TMD=1.901 $g/cm^3$). The fireset used for the flying-plate detonator was a 5.8 μF. capacitive-discharge unit (CDU) with 102 nH inductance and 46 mΩ resistance.

Figure 6:
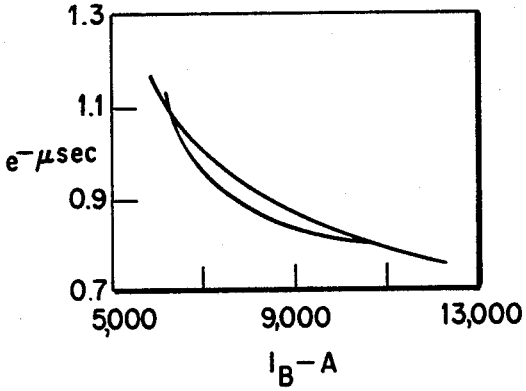
FIGS. 6 and 7 are graphs illustrating flying-plate initiation of high-density explosive pressings.
Figure 7:
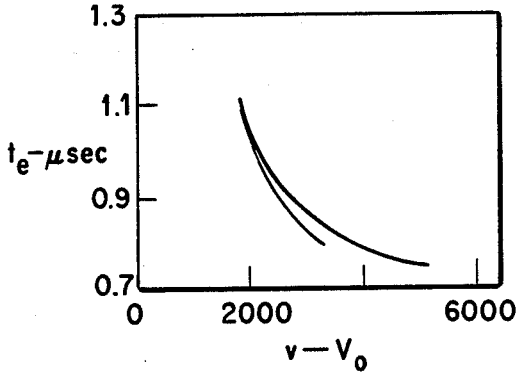

The results, in terms of $t_e$ vs $I_B$ (time from burst of the foil of closure of the ionization switch vs current value at burst) and $t_e$ vs $V_o$ ($V_o$ is firing voltage on the CDU, not burst voltage of foil) curves, are shown in the plots of FIGS. 6 and 7, along with the same curves for 3500 $cm^2/g$ PETN pellets at 90% TMD. The upper curve in each of FIGS. 6 and 7 represents PETN, the lower BTF (HNB), the density of the PETN being 1.6 $g/cm^3$ and 1.71 $g/cm^3$ for the BTF.

These high density tests have shown that BTF has, effectively, the same threshold as PETN to flying-plate initiation, but has shorter transmission times. As in the low-density pressing, the tight grouping of the data points about a smooth curve, as shown in FIGS. 6 and 7, indicates that good simultaneity could be obtained in salvo firing.

Figure 8:
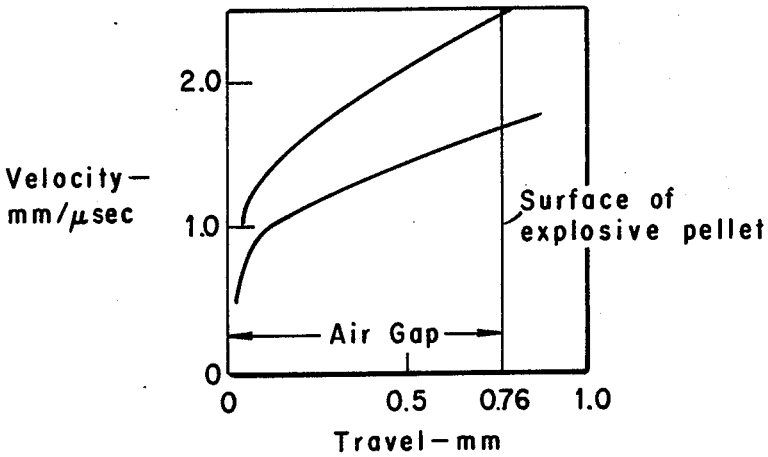
FIG. 8 is graphical illustration of velocity of the flyer vs distance of travel.

The velocity of Mylar and polyimide flyers of the flying-plate detonator has been tested. Two shots with no explosive pellets involved were fired at each of two CDU firing-voltage levels, 2 and 5 kV. The flyer location as a function of time was viewed with a streaking camera. The data was then converted to the plot of flyer velocity as a function of distance traveled, as shown in FIG. 8. The location of the explosive, when used, is also indicated.

It has thus been shown that the present invention provides an effective detonator for detonating high density explosives, the detonator being more thermally stable than the conventional PETN filled detonators, thereby substantially advancing the state of the art.

While particular embodiments of the inventive flying-plate detonator have been illustrated and described, modifications and changes will become apparent to those skilled in the art, and it is intended to cover in the appended claims all such modifications and changes as come within the spirit and scope of the invention.

What we claim is:

1. A flying-plate detonator comprising: a backing member, electrode means operatively positioned on opposite sides of an insulator means, said electrode means on one side of said insulator means being adjacent said backing member, means for directing electrical current through said electrode means, conductive film means mounted against and electrically connected to said electrode means, a flyer film means operatively positioned against said conductive film means, standoff means having a bore therein mounted at one end thereof against said flyer film means, and a high-density high explosive material positioned adjacent said standoff means at the opposite end thereof, whereby a large current pulse through said electrode means explosively vaporizes at least a portion of said conductive film means driving a flyer member from said flyer film means and through said bore of said standoff means striking said explosive material causing detonation thereof.

2. The flying-plate detonator defined in claim 1, wherein said electrode means comprises a pair of electrodes interconnected by a conductive jumper member.

3. The flying-plate detonator defined in claim 2, wherein one of said pair of electrodes comprises a pair of lands interconnected by a conductive bridgefoil constituting said conductive film means.

4. The flying-plate detonator defined in claim 1, wherein said insulator means comprises at least one layer of insulator material, and wherein said electrode means comprises a pair of electrically conductive layers secured on opposite sides of said insulator material, at least one of said pair of electrodes being configured to define a pair of lands interconnected by a bridgefoil constituting said conductive film means.

5. The flying-plate detonator defined in claim 4, wherein said insulator material and said flyer film means are constructed from the group selected from Mylar and polyimide.

6. The flying-plate detonator defined in claim 1, wherein said standoff means has a thickness in the range of 5 to 40 mils.

7. The flying-plate detonator defined in claim 1, wherein said high-density, high explosive material comprises a pellet of hexanitrosobenzene.

8. The flying-plate detonator defined in claim 1, wherein said flyer film means comprises a layer of material selected from the group consisting of Mylar and polyimide having a thickness of about 3 mils, wherein said standoff means has a thickness in the range of about 10 to 30 mils and a bore diameter in the range of about 15 to 250 mils, and wherein said high-density high explosive material is composed of hexanitrosobenzene.

9. The flying-plate detonator defined in claim 8, wherein said high-density, high explosive material comprises a pellet of hexanitrosobenzene bonded with Exon.

10. A flying-plate detonator utilizing a flying member for detonating an explosive comprising: a backing member, a pair of electrode means operatively positioned on opposite sides of an insulator means, said backing member being positioned against at least one of said pair of electrode means, means for electrically interconnecting and directing electrical current through said electrode means, flyer film means mounted against the other of said pair of electrode means, standoff means having a bore extending therethrough and mounted at one end thereof against said flyer film means, said bore being of a cross-section less than said flyer film means, said flyer film means being constructed such that a flyer member is cut out therefrom, and explosive material positioned adjacent said standoff means at the opposite end thereof, whereby a current pulse through said electrode means explosively vaporizes at least a portion of said other of said pair of electrode means cutting out said flyer member from said flyer means and driving said flyer member through said bore of said standoff means striking said explosive material causing detonation thereof.

11. The flying-plate detonator defined in claim 10, wherein said other of said pair of electrode means comprises a pair of land portions interconnected by a bridgefoil portion, said one end of said standoff means being positioned in alignment with said bridgefoil portion of said other of said pair of electrode means.

12. The flying-plate detonator defined in claim 10, wherein said means for electrically interconnecting and directing electrical current through said electrode means comprises an electrically conductive jumper means interconnecting one end portion of each of said pair of electrode means, and electrical supply means connected to the other end portion of each of said pair of electrode means.

13. The flying-plate detonator defined in claim 10, wherein said other of said pair of electrode means include a portion thereof of smaller cross-section, and wherein said standoff means is mounted such that said bore thereof is in alignment with said smaller cross-section portion of said other of said pair of electrode means.

* * * * *